US010576353B2

(12) United States Patent
Givens

(10) Patent No.: US 10,576,353 B2
(45) Date of Patent: Mar. 3, 2020

(54) NET ASSEMBLY FOR AN ADJUSTABLE BASKETBALL GOAL

(71) Applicant: Jon Casey Givens, Katy, TX (US)

(72) Inventor: Jon Casey Givens, Katy, TX (US)

(73) Assignee: MEGA SLAM HOOPS, LLC, San Antonio, TX (US)

( * ) Notice: Subject to any disclaimer, the term of this patent is extended or adjusted under 35 U.S.C. 154(b) by 75 days.

(21) Appl. No.: 15/701,620

(22) Filed: Sep. 12, 2017

(65) Prior Publication Data

US 2019/0076724 A1 Mar. 14, 2019

(51) Int. Cl.

| | |
|---|---|
| ***A63B 71/02*** | (2006.01) |
| ***A63B 69/00*** | (2006.01) |
| ***A63B 63/08*** | (2006.01) |
| ***A63B 1/00*** | (2006.01) |

(52) U.S. Cl.

CPC ..... *A63B 71/022* (2013.01); *A63B 1/00* (2013.01); *A63B 63/083* (2013.01); *A63B 69/0071* (2013.01)

(58) Field of Classification Search

CPC ... A63B 63/083; A63B 63/08; A63B 69/0071; A63B 69/0097; A63B 71/022

USPC ..... 473/431–435, 472, 476, 421, 477–484

See application file for complete search history.

(56) References Cited

U.S. PATENT DOCUMENTS

| | | | | |
|---|---|---|---|---|
| 2,986,398 | A * | 5/1961 | Rex | A63B 63/00 273/410 |
| 5,129,648 | A * | 7/1992 | Sweeney | A63B 63/083 473/433 |
| 5,785,616 | A * | 7/1998 | Dodge | A63B 63/083 473/479 |
| 7,455,603 | B2 * | 11/2008 | Bouffard | A63B 63/004 248/156 |
| 2006/0040769 | A1 * | 2/2006 | McNulty | A63B 69/0071 473/431 |
| 2006/0183571 | A1 * | 8/2006 | Hudson | A63B 69/0071 473/433 |
| 2013/0331208 | A1 * | 12/2013 | Elpers | A63B 71/022 473/476 |

* cited by examiner

*Primary Examiner* — John E Simms, Jr.
*Assistant Examiner* — Rayshun K Peng
(74) *Attorney, Agent, or Firm* — Nolte Intellectual Property Law Group

(57) ABSTRACT

A net assembly for an adjustable basketball goal. The net assembly may include a net, a support frame, and a mounting assembly configured to mount the support frame to a post of the adjustable basketball goal. The net may include a net frame having an upper portion including a plurality of net frame sleeves. The support frame may be configured to support the net, and may include at least one elongated member configured to extend through the plurality of net frame sleeves. The support frame may also include a plurality of support arms, each having a first end portion and a second end portion. The first end portion may be configured to couple to the at least one elongated member, and the second end portion may have a support arm sleeve. The support frame may further include a cross brace configured to couple the plurality of support arms.

20 Claims, 6 Drawing Sheets

NET ASSEMBLY FOR AN ADJUSTABLE BASKETBALL GOAL

BACKGROUND

Basketball goals are frequently used in areas outside of professional basketball arenas. These basketball goals are typically mounted to a pole or wall, and may include a mechanism to adjust the height of the goal. In many instances, when a pole is provided as the means for mounting the basketball goal at a residential location, the area behind the basketball goal may include objects (e.g., motor vehicles) susceptible to damage from a basketball as a result of an errant pass or shot by a player. In other instances in which the area behind the basketball goal may be free from any obstructions, an errant pass or shot by a player may result in the travel of the basketball a great distance from the basketball goal.

What is needed, therefore, is a barrier to prevent a basketball from damaging any objects located behind the basketball goal and/or to prevent the basketball from traveling past a set distance from a basketball goal.

SUMMARY

Embodiments of the disclosure may provide a net assembly for an adjustable basketball goal. The net assembly may include a net, a support frame, and a mounting assembly. The net may include a net frame, the net frame having an upper portion including a plurality of net frame sleeves. The support frame may be configured to support the net. The support frame may include at least one elongated member configured to extend through the plurality of net frame sleeves. The support frame may also include a plurality of support arms. Each support arm may have a first end portion and a second end portion. The first end portion may be configured to couple to the at least one elongated member, and the second end portion may have a support arm sleeve. The support frame may further include a cross brace configured to couple the plurality of support arms. The mounting assembly may be configured to mount the support frame to a post of the adjustable basketball goal.

Embodiments of the disclosure may further provide a net assembly for an adjustable basketball goal. The net assembly may include a net, a support frame, and a mounting assembly. The net may include a net frame, the net frame having an upper portion including a plurality of net frame sleeves. The support frame may be configured to support the net. The support frame may include a center rod having a first center rod end and a second center rod end. The support frame may also include a first outer rod configured to couple with the first center rod end, and a second outer rod configured to couple with the second center rod end. The support frame may further include a first support arm having a first end configured to couple to the center rod or the first outer rod, and a second support arm having a first end configured to couple to the center rod or the second outer rod. The support frame may also include a cross brace configured to couple to each of the first support arm and the second support arm. The mounting assembly may be configured to couple the net and the support frame to a post of the adjustable basketball goal. The mounting assembly may include an upper brace configured to couple the cross brace to the post of the adjustable basketball goal, and a lower brace configured to couple the first support arm and the second support arm to the post of the adjustable basketball goal.

Embodiments of the disclosure may further provide an adjustable basketball goal. The adjustable basketball goal may include a backboard, a rim assembly configured to couple to the backboard, a plurality of support arms configured to couple to the backboard, and a post configured to couple to the plurality of support arms. The adjustable basketball goal may also include an actuator assembly and a net assembly. The actuator assembly may be configured to couple to the post and the plurality of support arms. The actuator assembly may include an actuator configured to adjust a height of the adjustable basketball goal. The net assembly may be configured to couple to the post and may include a net configured to anchor to the ground.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
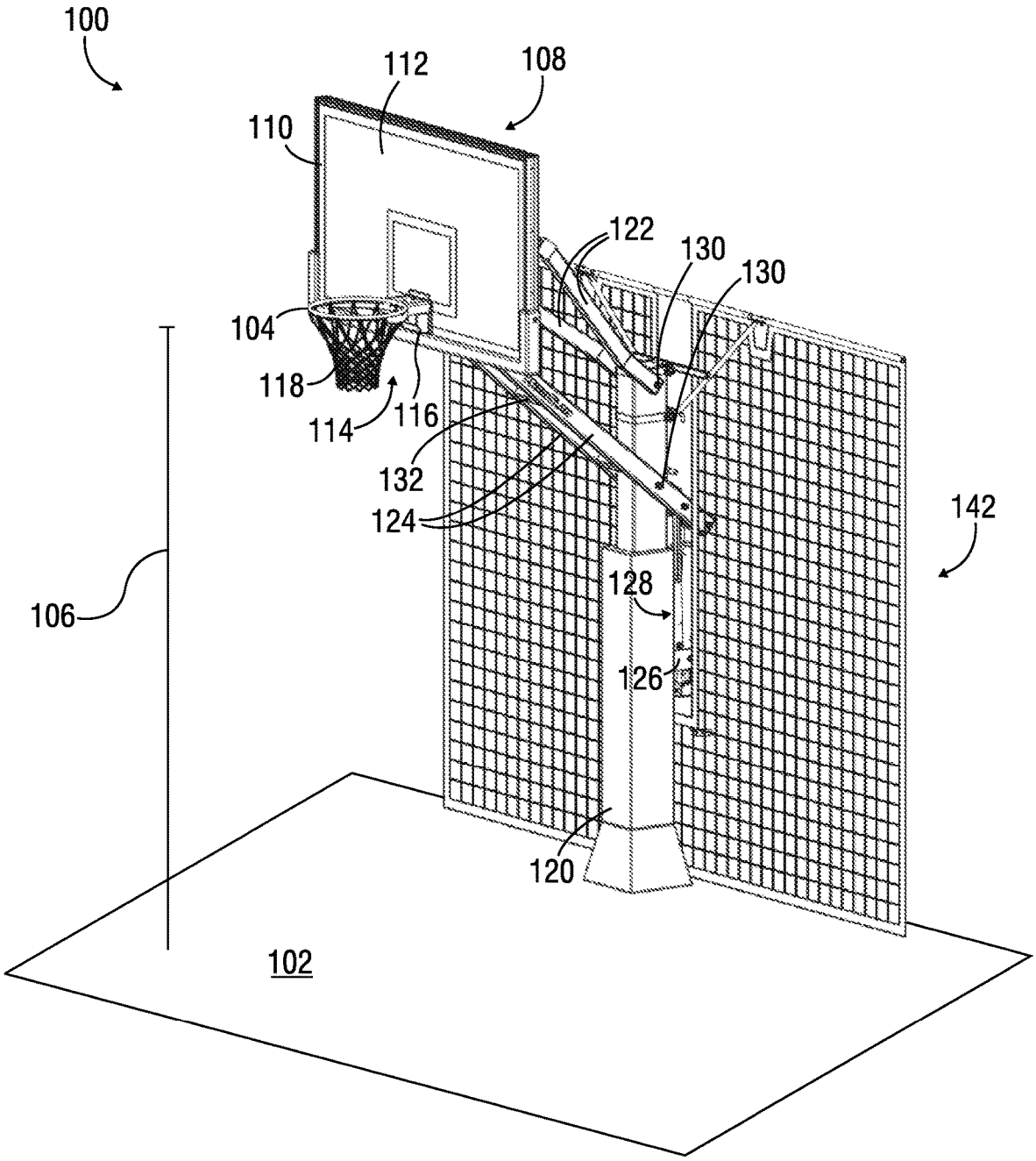
FIG. 1 illustrates a perspective view of an adjustable basketball goal including a net assembly, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 2:
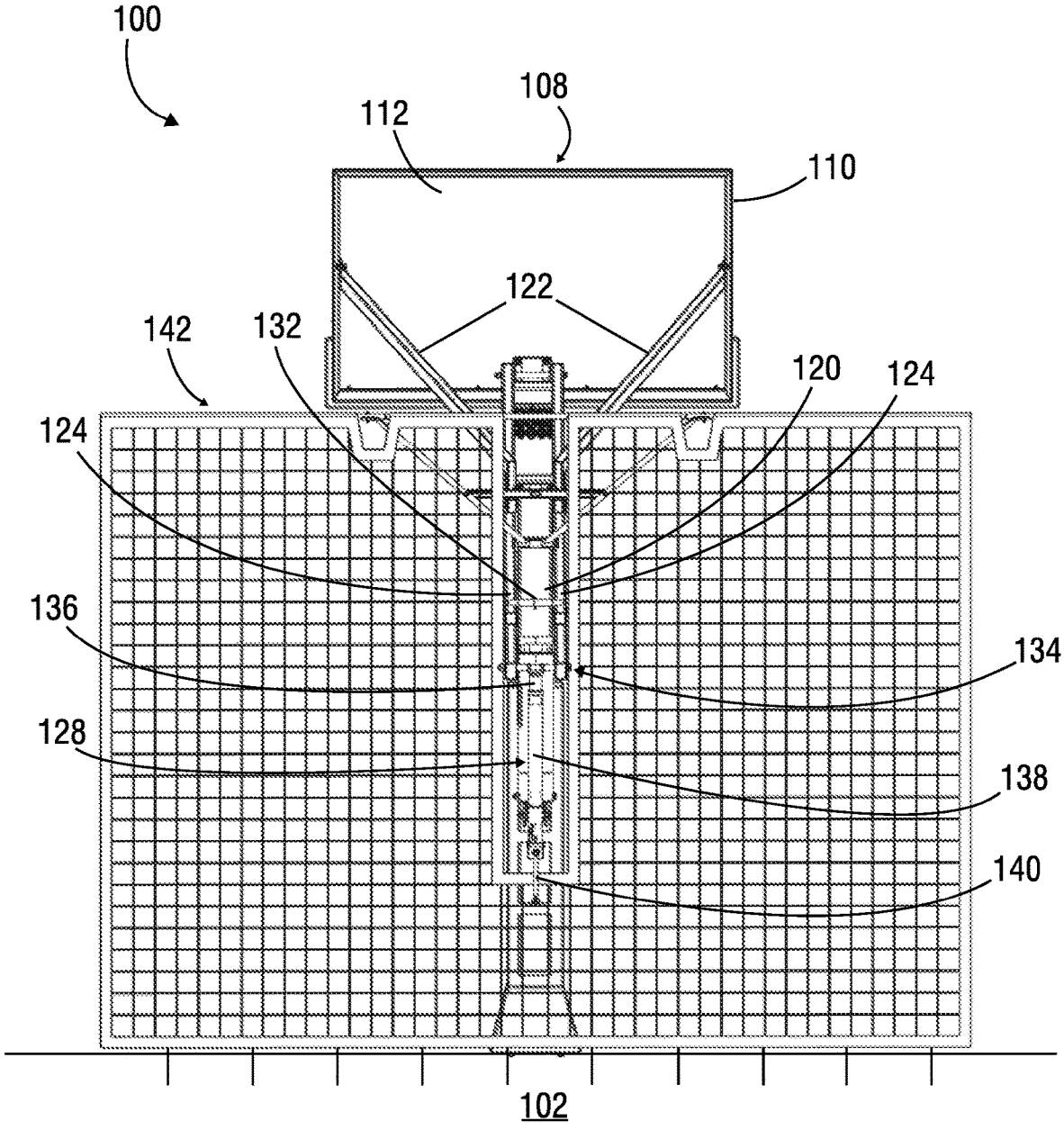
FIG. 2 illustrates a rear view of the adjustable basketball goal of FIG. 1.

FIGS. 1 and 2 illustrate respective perspective and rear views of an adjustable basketball goal 100, according to one or more embodiments of the present disclosure. As will be discussed in further detail below and shown most clearly in FIG. 1, the adjustable basketball goal 100 may be anchored to the ground 102 and configured to position a rim 104 thereof at a plurality of heights (one shown 106) ranging from about five feet above the ground 102 to about ten feet above the ground 102.

As the adjustable basketball goal 100 may be more susceptible to "dunking" or "slamming" of the basketball (not shown) through the rim 104 at a lowered position, a backboard 108 of the adjustable basketball goal 100 may include a backboard support frame 110 surrounding a panel 112. In one or more embodiments, the panel 112 may be constructed from a clear material, such as glass, tempered glass, plexiglass, or polycarbonate. This may allow a clear view through the panel 112.

As shown most clearly in FIG. 1, a rim assembly 114 including the rim 104 and a mounting plate 116 may be coupled to the backboard 108. In particular, in one or more embodiments, the mounting plate 116 may be coupled to the backboard support frame 110 using bolts, adhesives, welds, or other similar means. In other embodiments, the mounting plate 116 may also be coupled to the panel 112 using bolts or adhesives. In some embodiments, a cloth or chain net 118 may be attached to the rim 104.

The rim assembly 114 may be a fixed type rim assembly with the mounting plate 116 and the rim 104 rigidly coupled together. In other embodiments, the rim assembly 114 may be a collapsible style rim assembly. A collapsible style rim assembly may allow the rim 104 to flex independently of the mounting plate 116, allowing the rim assembly 114 to absorb some of the force when the rim 104 is pulled during or after "dunking" or "slamming" the basketball therethrough.

The adjustable basketball goal 100 may further include a post 120, a plurality of support arms 122, 124 coupling the post 120 to the backboard 108, an actuator mounting bracket 126, and an actuator assembly 128. The post 120 may be anchored to the ground 102 and extend substantially vertically therefrom. In one or more embodiments, the post 120 may be anchored to the ground 102 via concrete and a plurality of fasteners such as screws or bolts (not shown). In at least one embodiment, the post 120 may be rectangular in cross section; however, in other embodiments, the post 120 may be square, circular, or oval in cross section. The post 120 may be at least partially covered in padding (not shown) constructed from foam or other like material.

The backboard 108 may be coupled to the post 120 via the plurality of support arms 122, 124. The plurality of support arms 122, 124 may include a pair of upper support arms 122 pivotably attached to the post 120 and a pair of lower support arms 124 pivotably attached to the post 120 and vertically spaced from the pair of upper support arms 122. Each of the upper support arms 122 and the lower support arms 124 may be pivotably attached to the post 120 using one or more bolts or pins 130. In one or more embodiments, each of the pair of upper support arms 122 and the pair of lower support arms 124 may include one or more cross members 132 extending therebetween to provide structural support thereto.

Respective end portions 134 of the pair of lower support arms 124 may be coupled to the actuator assembly 128. More particularly, in one or more embodiments, the respective end portions 134 of the pair of lower support arms 124 may be coupled to an extendable or retractable shaft 136 of an actuator 138 of the actuator assembly 128. The actuator 138 may be further coupled to the post 120 via the actuator mounting bracket 126, as shown in FIGS. 1 and 2. A crankshaft 140 may be detachably attached to the actuator 138 and configured to rotate in a clockwise or counterclockwise direction to increase or decrease the height 102 of the rim 104 of the adjustable basketball goal 100.

Figure 3:
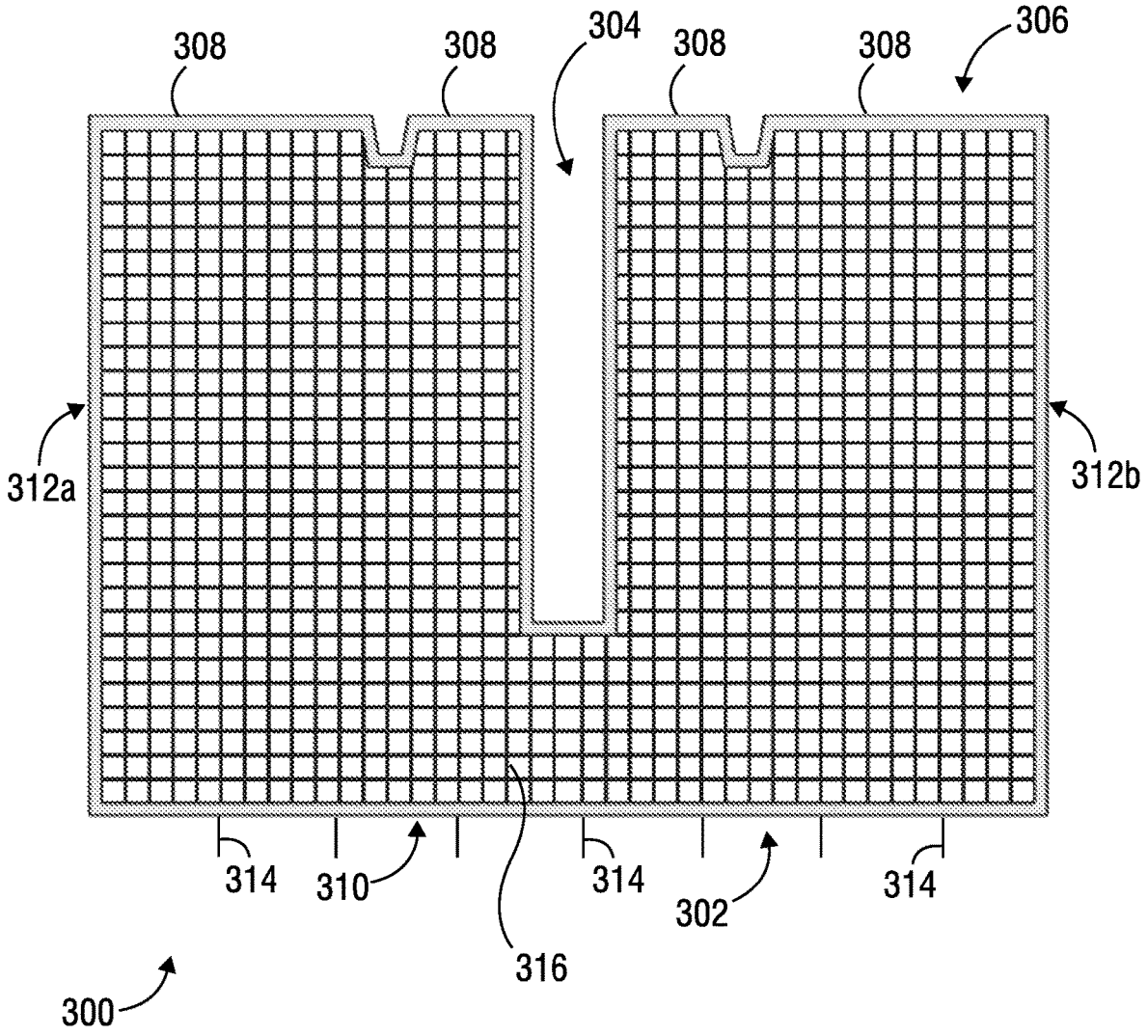
FIG. 3 illustrates a front view of a net of the net assembly, according to one or more embodiments.

As shown in FIGS. 1 and 2, the adjustable basketball goal 100 may further include a net assembly 142 installable on the post 120 and configured to prevent damage to surrounding objects (e.g., motor vehicles) and/or to prevent travel of the basketball past a set distance from the adjustable basketball goal 100. Referring now to FIGS. 3-6 with continued reference to FIGS. 1 and 2, the net assembly 142 may include a net 300, a mounting assembly 400, and a support frame 500. FIG. 3 illustrates a front view of the net 300, according to one or more embodiments.

The net 300 may include a net frame 302 forming a perimeter of the net 300 and forming in part a cut-out 304 through which the post 120 may be accessible for adjustment of the adjustable basketball goal 100. In addition, the cut-out 304 may provide access to the mounting assembly 400 (FIG. 4), which is discussed in greater detail below. An upper portion 306 of the net frame 302 may include a plurality of net frame sleeves (four shown 308) extending substantially parallel with the ground 102 (FIGS. 1 and 2). Each of the net frame sleeves 308 may define a bore (not shown) being coaxial with the bores of the other net frame sleeves 308. The upper portion 306 may be coupled to a lower portion 310 of the net frame 302 via opposing side portions 312*a* and 312*b* of the net frame 302.

The lower portion 310 of the net frame 302 may include a plurality of stakes 314 extending substantially vertically therefrom, where each of the stakes 314 may be configured to extend into the ground 102, thereby anchoring the lower portion 310 of the net 300 to the ground 102. A netting 316 in the form of a grid may extend between the upper portion 306, side portions 312*a*, 312*b*, and lower portion 310 and may be constructed from any material known in the art including, but not limited to, nylon, woven rope, and steel. As constructed, the net 300 may be configured to prevent a basketball from traveling therethrough.

Figure 4:
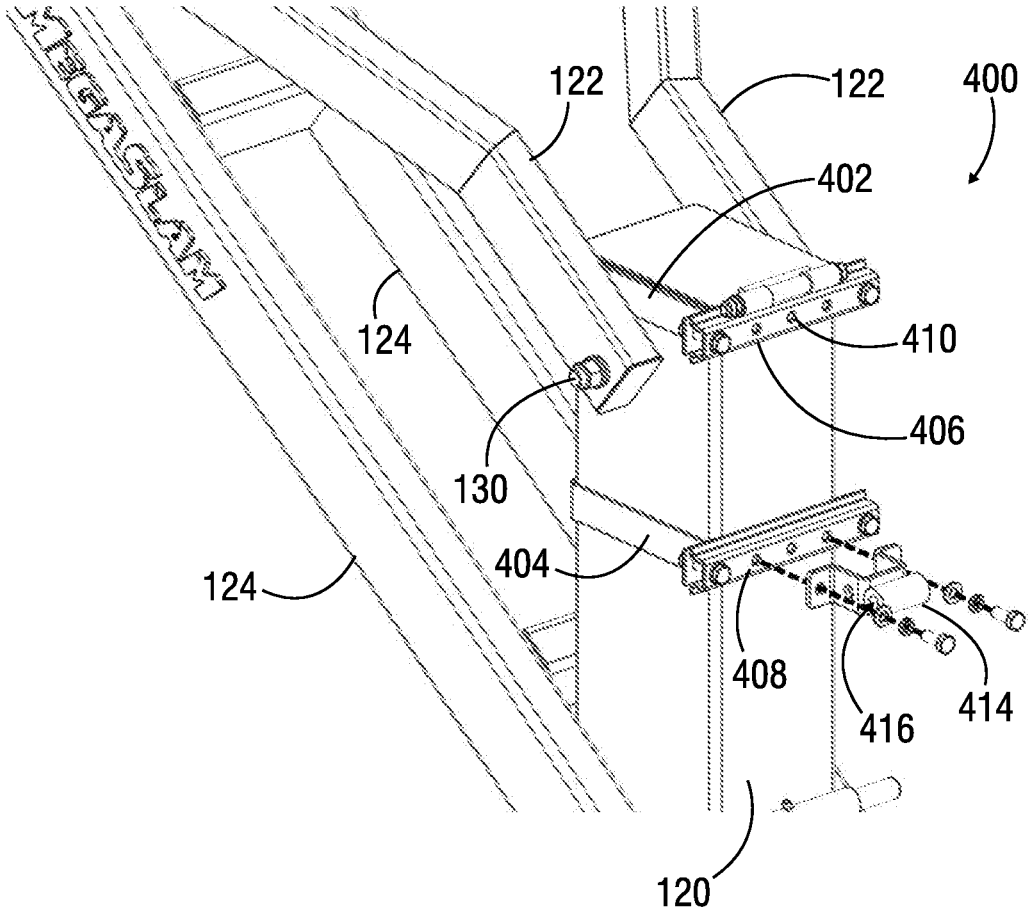
FIG. 4 illustrates an enlarged perspective view of a mounting assembly of the net assembly installed on a post of the adjustable basketball goal, according to one or more embodiments.

FIG. 4 illustrates a perspective view of the mounting assembly 400 installed on the post 120, according to one or more embodiments. The mounting assembly 400 may be configured to support the net 300. To that end, the mounting assembly 400 may include an upper bracket 402 and a lower bracket 404 vertically spaced from the upper bracket 402 as installed on the post 120. In at least one embodiment, each of the upper bracket 402 and the lower bracket 404 may be U-shaped. The mounting assembly 400 may further include an upper brace 406 and a lower brace 408 respectively coupled to the upper bracket 402 and the lower bracket 404 via fasteners, such as bolts, screws, or the like, as installed on the post 120.

As installed on the post 120, the upper bracket 402 and the upper brace 406 may encompass the post 120, and the lower bracket 404 and the lower brace 408 may likewise encompass the post 120. The upper brace 406 may define an aperture 410 through which a fastener 412 (FIGS. 5 and 6) may extend to couple the support frame 500 (FIGS. 5 and 6) thereto. The lower brace 408 may further include a lower brace sleeve 414 integral therewith or attached thereto via fasteners, such as bolts, screws, or the like (as shown in FIG. 4), and defining a bore 416 extending therethrough.

Figure 5:
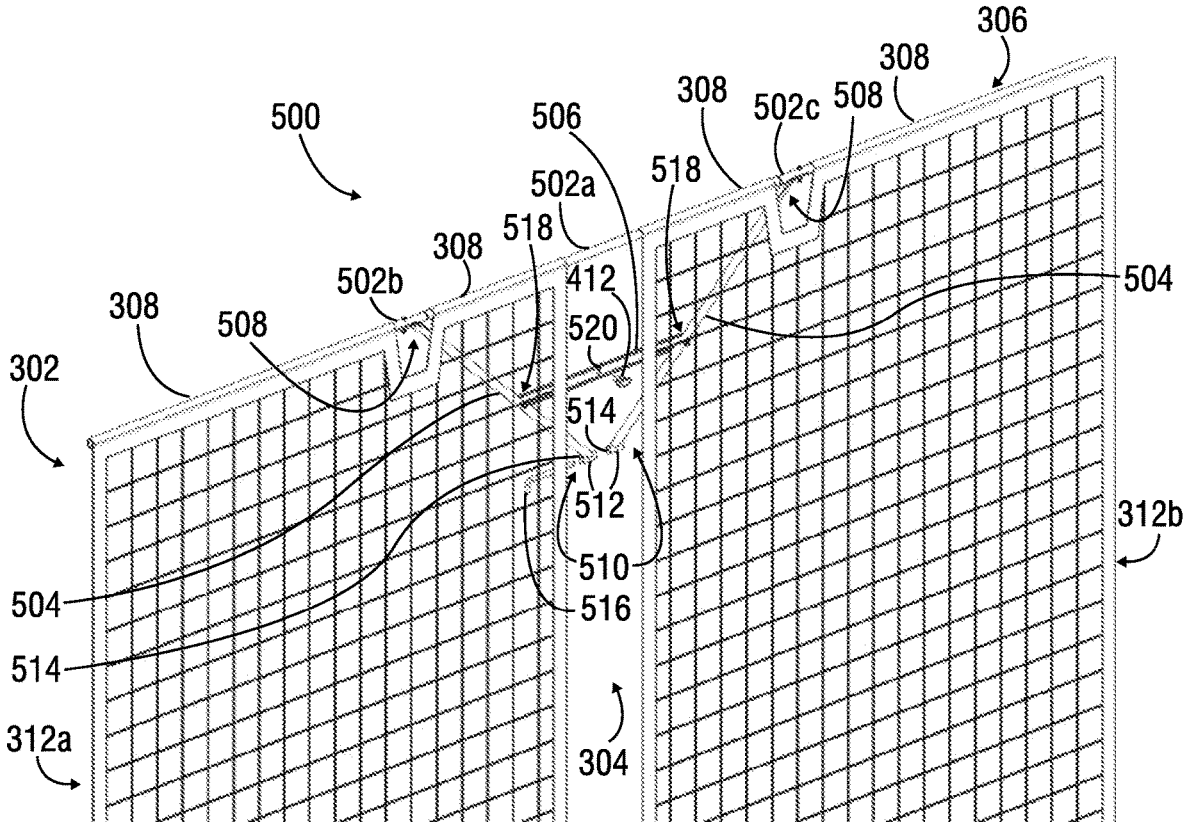
FIG. 5 illustrates a perspective view of a support frame of the net assembly, according to one or more embodiments.
Figure 6:
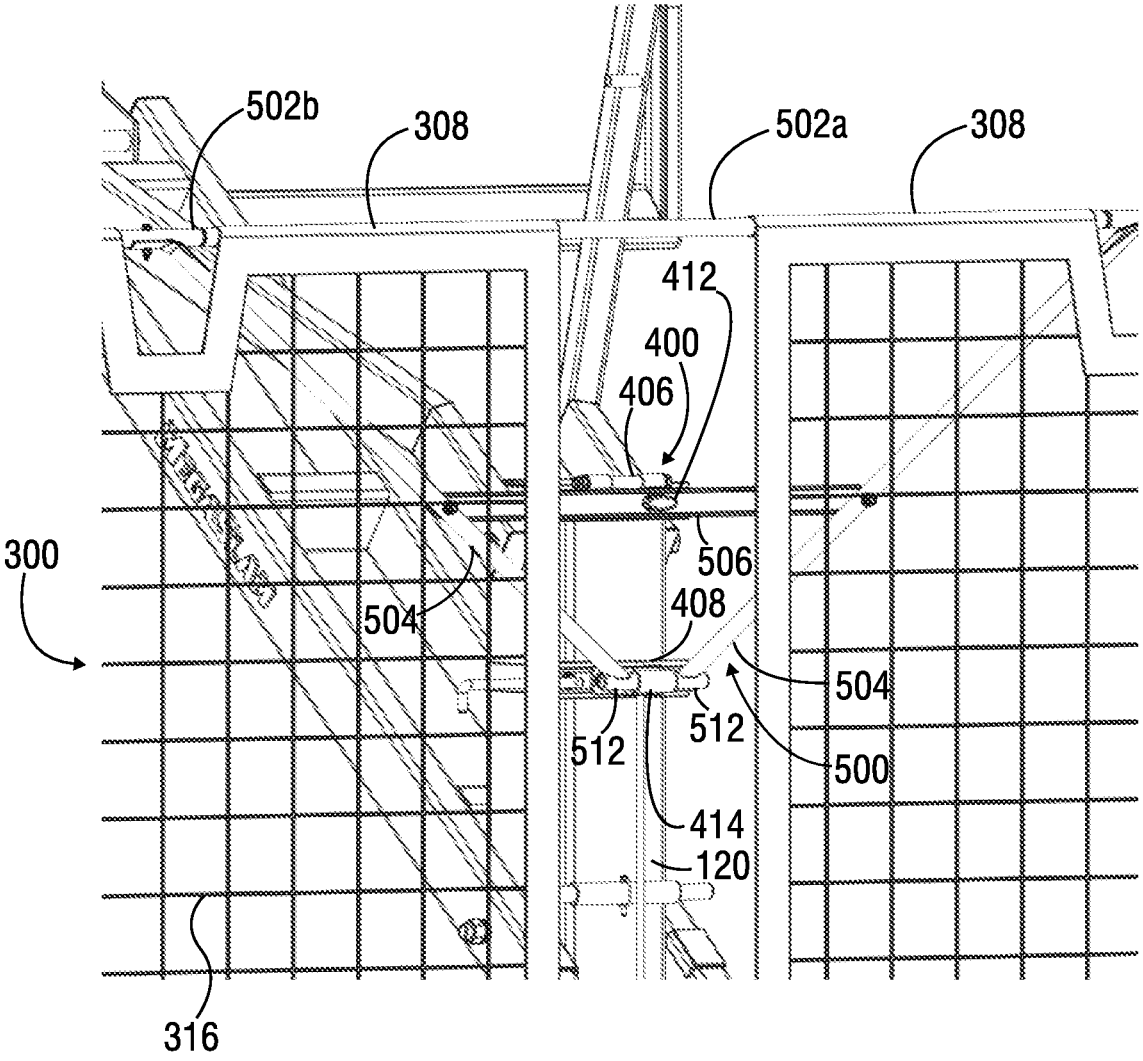
FIG. 6 illustrates a perspective view of the net assembly installed on the post, according to one or more embodiments.

FIG. 5 illustrates a perspective view of the support frame 500 of the net assembly 142, according to one or more embodiments. FIG. 6 illustrates the support frame 500 supporting the net 300 and coupled to the post 120 via the mounting assembly 400, according to one or more embodiments. The support frame 500 may include one or more elongated members, illustrated as rods (three shown 502*a-c*), sized and configured to extend through the bores defined by the net frame sleeves 308 in the upper portion 306 of the net frame 302. In embodiments including a plurality of elongated members 502*a-c*, the plurality of elongated members 502*a-c* may include a center elongated member 502*a* having ends threadingly coupled to a first outer elongated member 502*b* and a second outer elongated member 502*c*, thereby forming a single elongated member extending through the bores defined by the net frame sleeves 308. The elongated members 502*a-c* may extend along the upper portion 306 from one side portion 312*a* to the other side portion 312*b*.

The support frame 500 may further include a plurality of support arms (two shown 504) and a cross brace 506 configured to couple the elongated members 502*a-c* to the post 120. More particularly, in at least one embodiment, the plurality of support arms 504 may couple the elongated members 502*a-c* to the lower brace 408, and the cross brace 506 may be configured to couple the elongated members 502*a-c* to the upper brace 406 via the plurality of support arms 504. As shown in FIG. 5, each of the support arms 504 includes an end portion 508 coupled to an elongated member 502*a-c* utilizing fasteners, such as bolts, screws, or the like. In one embodiment, a first end portion 508 of one support arm 504 may be coupled to the first outer elongated member 502*b* and a first end portion 508 of the other support arm 504 may be coupled to the second outer elongated member 502*c*. In another embodiment, the first end portions 508 of each support arm 504 may be coupled to the center elongated member 502*a*.

An opposing second end portion 510 of each support arm 504 may form or have a support arm sleeve 512 defining a bore 514 extending therethrough. A fastening member 516, such as a pin, may extend though the bores 514, 416 of the support arms 504 and the lower brace sleeve 414 as coaxially aligned, thereby coupling the support arms 504 to the post 120. The cross brace 506 may have end portions 518 coupled to respective support arms 504 utilizing fasteners, such as bolts, screws, or the like, and may further define a center aperture 520 through which the fastener 412, e.g., knob, may extend therethrough and into the aperture 410 defined in the upper brace 408, thereby coupling the support arms 504 to the post 120.

The description herein uses terms such as 'lower', 'upper', etc., that are relative in nature. Those skilled in the art and having the benefit of this disclosure will appreciate that these terms are used relative to the orientation of the adjustable basketball goal 100 and components thereof with respect to the ground 102, as in, for example, FIGS. 1 and 2.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A net assembly for an adjustable basketball goal, comprising:

a net including a netting and a net frame, the net frame having an upper portion including a plurality of net frame sleeves and a lower portion, the netting extending between the upper portion and the lower portion;

a support frame configured to support the net, the support frame comprising at least one elongated member configured to extend through the plurality of net frame sleeves;

a plurality of support arms, each support arm having a first end portion and a second end portion, the first end portion configured to couple to the at least one elongated member and the second end portion having a support arm sleeve; and a cross brace configured to couple the plurality of support arms; and a mounting assembly configured to mount the support frame to a post of the adjustable basketball goal.

2. The net assembly of claim 1, wherein the net further includes a plurality of stakes extending from the lower portion of the net frame, the plurality of stakes configured to anchor the net to the ground.

3. The net assembly of claim 1, wherein the mounting assembly comprises:

an upper brace;

an upper bracket configured to couple the upper brace to the post;

a lower brace; and a lower bracket configured to couple the lower brace to the post.

4. The net assembly of claim 3, wherein the cross brace is configured to detachably attach to the upper brace via a fastener.

5. The net assembly of claim 3, wherein the lower brace includes a lower brace sleeve configured to align with and be disposed between the support frame sleeves.

6. The net assembly of claim 5, wherein each support arm sleeve is configured to detachably attach to the lower brace via a fastener.

7. The net assembly of claim 6, wherein the fastener is a pin extending through each of the support frame sleeves and the lower brace sleeve.

8. The net assembly of claim 1, wherein:

the net frame include a first side portion and a second side portion each extending between the upper portion and the lower portion;

the support frame includes a first elongated member, a second elongated member, and a third elongated member;

the second elongated member and the third elongated member are threadingly attached to the first elongated member; and the first elongated member, the second elongated member, and the third elongated member are configured to extend within the net frame sleeves from the first side portion to the second side portion of the net frame.

9. The net assembly of claim 3, wherein the upper bracket and the lower bracket are each U-shaped.

10. A net assembly for an adjustable basketball goal, comprising:

a net including a netting and a net frame, the net frame having an upper portion including a plurality of net frame sleeves and a lower portion, the netting extending between the upper portion and the lower portion;

a support frame configured to support the net, the support frame comprising a center rod having a first center rod end and a second center rod end;

a first outer rod configured to couple with the first center rod end;

a second outer rod configured to couple with the second center rod end;

a first support arm having a first end configured to couple to the center rod or the first outer rod;

a second support arm having a first end configured to couple to the center rod or the second outer rod; and a cross brace configured to couple to each of the first support arm and the second support arm;

a mounting assembly configured to couple the net and the support frame to a post of the adjustable basketball goal, the mounting assembly comprising an upper brace configured to couple the cross brace to the post of the adjustable basketball goal; and a lower brace configured to couple the first support arm and the second support arm to the post of the adjustable basketball goal.

11. The net assembly of claim 10, wherein:

the first support arm has a second end having a first support arm sleeve; and the second support arm has a second end having a second support arm sleeve.

12. The net assembly of claim 11, wherein:

the lower brace includes a lower brace sleeve; and the mounting assembly further includes a fastener configured to extend through each of the lower brace sleeve, the first support arm sleeve, and the second support arm sleeve to couple the first support arm and the second support arm to the post of the adjustable basketball goal.

13. The net assembly of claim 12, wherein the fastener is a pin.

14. The net assembly of claim 10, wherein the mounting assembly further comprises:

an upper bracket configured to couple with the upper brace to encompass the post of the adjustable basketball goal;

a lower bracket configured to couple with the lower brace to encompass the post of the adjustable basketball goal; and a fastener configured to couple the cross brace to the upper brace.

15. The net assembly of claim 10, wherein the net further includes a plurality of stakes extending from the lower portion of the net frame, the plurality of stakes configured to anchor the net to the ground.

16. An adjustable basketball goal, comprising:

a backboard;

a rim assembly configured to couple to the backboard;

a plurality of support arms configured to couple to the backboard;

a post configured to couple to the plurality of support arms;

an actuator assembly configured to couple to the post and the plurality of support arms, the actuator assembly comprising an actuator configured to adjust a height of the adjustable basketball goal; and a net assembly configured to couple to the post and comprising a net configured to anchor to the ground, the net including a netting and a net frame, the net frame having an upper portion including a plurality of net frame sleeves and a lower portion, the netting extending between the upper portion and the lower portion;

wherein the net assembly further comprises:

a support frame configured to support the net, the support frame comprising:

at least one elongated member configured to extend through the plurality of net frame sleeves;

a plurality of support arms, each support arm of the net assembly having a first end portion and a second end portion, the first end portion configured to couple to the at least one elongated member and the second end portion having a support arm sleeve; and a cross brace configured to couple the plurality of support arms of the net assembly.

17. The adjustable basketball goal of claim 16, wherein the net assembly further comprises a mounting assembly configured to mount the support frame to the post of the adjustable basketball goal.

18. The adjustable basketball goal of claim 16, wherein the net further includes a plurality of stakes extending from the lower portion of the net frame, the plurality of stakes configured to anchor the net to the ground.

19. The adjustable basketball goal of claim 17, wherein:

the mounting assembly comprises an upper bracket, a lower bracket, an upper brace coupled to the upper bracket to encompass the post, and a lower brace coupled to the lower bracket to encompass the post;

the cross brace is configured to detachably attach to the upper brace via a first fastener;

the lower brace includes a lower brace sleeve configured to align with and be disposed between the support frame sleeves; and each support arm sleeve is configured to detachably attach to the lower brace via a second fastener.

20. The adjustable basketball goal of claim 19, wherein the second fastener is a pin configured to extend through each of the support frame sleeves and the lower brace sleeve.

* * * * *